US007347791B1

(12) United States Patent
Watkins et al.

(10) Patent No.: US 7,347,791 B1
(45) Date of Patent: Mar. 25, 2008

(54) SEPARABLE GOLF CLUB SYSTEM AND METHODS OF USE

(75) Inventors: Philip G. Watkins, Torrance, CA (US); Louis Oberman, 12937 Caminito Del Canto, Del Mar, CA (US) 92104

(73) Assignee: Louis Oberman, Del Mar, CA (US)

( * ) Notice: Subject to any disclaimer, the term of this patent is extended or adjusted under 35 U.S.C. 154(b) by 0 days.

(21) Appl. No.: 11/519,369

(22) Filed: Sep. 11, 2006

(51) Int. Cl.
*A63B 53/10* (2006.01)
*A63B 53/12* (2006.01)

(52) U.S. Cl. ..... 473/288; 403/296

(58) Field of Classification Search ..... 473/288, 473/239, 296–299, 307; 403/293, 296, 305–306, 403/341

See application file for complete search history.

(56) References Cited

U.S. PATENT DOCUMENTS

| | | | | |
|---|---|---|---|---|
| 1,565,069 | A | 12/1925 | Edwards | |
| 2,463,053 | A | 3/1949 | Pritchard | |
| 3,516,697 | A | 6/1970 | Hahn | |
| 4,253,666 | A | 3/1981 | Murphy | |
| 4,340,227 | A | 7/1982 | Dopkowski | |
| 4,856,782 | A | 8/1989 | Cannan | |
| 5,390,921 | A | 2/1995 | De Ruyter | |
| 5,413,338 | A | 5/1995 | Kawamatsu | |
| 5,597,362 | A | 1/1997 | Lee et al. | |
| 5,765,691 | A | 6/1998 | Hall | |
| 5,792,006 | A | 8/1998 | Hesser | |
| 5,857,923 | A | 1/1999 | Veller | |
| 6,039,659 | A | 3/2000 | Hamm | |
| 6,447,404 | B1 | 9/2002 | Wilbur | |
| 6,743,116 | B2 | 6/2004 | Wilbur | |
| 2003/0050132 | A1 * | 3/2003 | Wilbur | 473/296 |
| 2003/0181255 | A1 * | 9/2003 | Ho | 473/316 |

OTHER PUBLICATIONS

Edwin Watts Golf, Momentus Traveler Training Aid, www.edwinwatts.com Jan. 12, 2006.

Roger Dunn Golf Shops, Clubhouse Collection Executive Putting Set, www.worldwidegolfshops.com Jan. 8, 2006.

* cited by examiner

*Primary Examiner*—Stephen Blau
(74) *Attorney, Agent, or Firm*—Luce, Forward, Hamilton & Scripps LLP; Michael J. DeHaemer, Jr.

(57) ABSTRACT

Apparatus and methods for providing a separable golf club are provided involving a connector having a male connector and a female connector configured to be selectively matable. The male and female connectors are configured to facilitate assembly of the connector with a reduced likelihood of damage to threaded portions of each component by the presence of complementary engaging surfaces, such as blunt tip and smooth alignment portions of the male connector. Additionally, the male and female connectors each may have a shoulder portion with a larger dimension than other portions of the connector in order to provide a secure coupling of the components.

9 Claims, 4 Drawing Sheets

SEPARABLE GOLF CLUB SYSTEM AND METHODS OF USE

FIELD OF THE INVENTION

The present invention relates to apparatus and methods for providing separable golf clubs. A number of heads may be used with a single handle, facilitating the portability of the clubs. The invention may be incorporated into a full or partial set of golf clubs, and may be used in the conversion of single shaft golf clubs to separable shaft golf clubs.

BACKGROUND OF THE INVENTION

Golf is a sport that has been enjoyed for many years and enjoys growing popularity in recent times. As is well known, golfing involves the use of a number of different clubs when playing a course, and golfers typically will use two or more different clubs per hole. As a result, golfers generally carry a heavy set of clubs that include drivers, irons, wedges and a putter.

Caddies and golf carts may facilitate the transportation of a set of golf clubs over a course. But, a golfer who travels must still tote this large and heavy collection through airports or other travel centers. As a result, business travelers and other who wish to enjoy golfing when away from home typically transport large bulky sets of clubs with them.

Unfortunately, carrying a large set of clubs may not always be practical. For example, an airline passenger may be limited by luggage weight or the number of items allowed onboard the plane. Likewise, the ever-increasing airport security restrictions may impose other burdens on golfers that result in making the transportation of golf clubs inconvenient or perhaps even impermissible. As a result, the golfer may not choose to travel with a set of clubs and may miss the opportunity to play golf or practice swinging.

When a golfer does not play golf or have another opportunity to practice swinging, that golfer's game may suffer. Magazines and other publications discussing golf commonly report that practicing the swing is important in maintaining the golfer's abilities. In particular, publications have identified the "short game" of putting, pitching, and chipping as a part of the game that requires a significant amount of practice in order to maintain and improve one's golfing skills around the green. Accordingly, it is desirable to provide one or more golf clubs that may be easily transported for this purpose.

In attempts to provide portable golf clubs, others have devised various golf clubs that may be separated into two or more components. For example, U.S. Pat. No. 1,565,069 is an early example of such an attempt. This patent discloses a golf club having an enlarged central portion with a threaded connector. Although separable, this club involved the use of a conspicuous sleeve in the central section.

U.S. Pat. No. 4,340,227 illustrates another example of a separable club. That patent describes two portions of a club having a threaded connector in which a threaded portion is adjacent to the open end. One disadvantage of this design is that the connector may become damaged due to improper assembly.

U.S. Pat. No. 5,857,923 illustrates another example of a separable club. That patent describes two portions of a club having a threaded connector in which the shaft ends overlap when connected. One disadvantage of this design is that the club may be shortened due to the overlapping of the two shaft ends.

U.S. Pat. No. 6,039,659 describes an interchangeable shaft golf club in which the head is removable from the shaft. A disadvantage of such a design is that the golfer must still accommodate a relatively long shaft when transporting the club.

U.S. Pat. No. 6,447,404 describes a separable-shaft golf club. This patent describes hollow male and female connector members that connect first and second hollow shaft members together. Disadvantages of this design include the increased manufacturing costs associated with the hollowed components and the susceptibility of damaging the threaded components during assembly.

U.S. Pat. No. 6,743,116 describes a separable-shaft golf club that uses a threaded connector to connect first and second shaft members together. In particular, the connector may be placed on the exterior of a graphite club shaft. Disadvantages of this design include the conspicuous connector located in a central portion of the shaft.

In view of the foregoing, it is desirable to provide apparatus and methods of allowing selective separation of a golf club to facilitate portability.

It further would be desirable to provide apparatus and methods of providing portability of numerous golf clubs while reducing the weight of the full or partial set of clubs.

It would be further desirable to provide apparatus and methods of connecting separable golf clubs that reduces the concentrated areas of stress between components of the system.

It still would be further desirable to provide apparatus and methods of converting single shaft golf clubs to golf clubs having separable shafts.

SUMMARY OF THE INVENTION

In view of the above-listed disadvantages of the prior art, it is a feature of the present invention to provide apparatus and methods of allowing selective separation of a golf club to facilitate portability.

It is a further feature of the present invention to provide apparatus and methods of providing portability of numerous golf clubs while reducing the weight of the full or partial set of clubs.

It also is a feature of the present invention to provide apparatus and methods of connecting separable golf clubs that facilitates connectivity and reduces the likelihood of damage to the connector.

It still further is a feature of the present invention to provide apparatus and methods of converting single shaft golf clubs to golf clubs having separable shafts.

These and other advantages may be accomplished by providing a golf club system having a connector system that allows the clubs to be disassembled for compact storage. The connector system includes a male connector that may be affixed to one section of a golf club shaft, and a female connector that may be affixed to another section of a golf club shaft. The male connector may be selectively mated with the female connector in order to assemble the golf club for use.

The male connector has a first portion that couples to a section of a golf club shaft and a protruding section that is engagable with a female connector. The protruding section has a blunt tip, and a smooth portion, with a threaded portion therebetween. Assembly of the golf club shaft is facilitated and the likelihood of damage to the threaded area is reduced.

The female connector couples to another section of a golf club. The female connector has a first cavity, a second cavity, and a third cavity adjacent to one another and configured to receive the smooth portion, threaded portion, and blunt tip of the male connector, respectively.

The connectors are adapted to connect the shaft of a golf club having at least two members. In a preferred embodiment, the golf club has a hollow steel shaft, where each of two members of the shaft has a cavity. As such, the first portion of the male connector is dimensioned to be received in the cavity of one member of the golf club shaft and the second portion of the female connector is dimensioned to be received in a cavity of another member of the golf club shaft. The first and second shaft members may then be selectively coupled and uncoupled, thereby allowing assembly and disassembly of the club.

In a preferred embodiment, the male connector is threaded over at least a length of the protruding section, and the female connector has a matching threaded portion over at least a length of the second cavity. When the male connector is mated with the female connector, the protruding section of the male connector is received in the female connector. In a preferred embodiment, the blunt tip portion and the smooth portion of the male connector engage the complementary cavities of the female connector prior to the engagement of the threaded portions. Accordingly, the male portion and the female portion thereby may be axially aligned so as to reduce the likelihood of damage to the threaded portions due to improper assembly, as may occur if the golf club members are not aligned properly as in known systems.

Additionally, a plurality of club heads may be provided with connectors adapted to be selectively mated with a single grip, thereby reducing the weight and bulk of the clubs. For example, a grip portion of a golf club may be attached to a connector that is adapted to couple with connectors in three corresponding wedges and a putter, so that a golfer may travel with a compact set of clubs and practice his or her "short game" without the need to carry four full sized clubs.

In a preferred embodiment, referred to as the "4-in-One" system, a grip portion of a golf club shaft is matable with three separate wedges and a putter. In the 4-in-One system, the grip portion of the handle is coupled to one of either a male or female portion, and each of the club head portions is coupled to a mating connector portion. For example, the grip portion may be coupled to a male portion, and each of the wedges and the putter may be coupled to a respective female portion. In such an embodiment, a golfer may travel with the 4-in-One system to "take the short game on the road", and thereby be able to play or practice in remote locations without the burden of carrying four full size clubs.

It will be appreciated that a golfer who has become accustomed to a particular set of clubs may prefer converting that set into a separable set of clubs rather than acquiring a new set of separable clubs. Thus, in accordance with another aspect of the present invention, a method is provided for converting a single shaft golf club shaft into a golf club having a separable shaft. This method involves separating the shaft of the single shaft golf club into at least two sections, and attaching a male connector to one section and a female connector to another section.

These and other features and advantages of the present invention will be appreciated from review of the following detailed description of the invention, along with the accompanying figures in which like reference numerals refer to like parts throughout.

BRIEF DESCRIPTION OF THE DRAWINGS

The above and other objects and advantages of the present invention will be apparent upon consideration of the following detailed description, taken in conjunction with the accompanying drawings, in which like reference numerals refer to like parts throughout, and in which.

DETAILED DESCRIPTION OF THE INVENTION

The present invention is directed to a golf club set having a club with a shaft that is separable into at least two members. The golf club employs a connector that may be used to provide selective coupling between a grip and one or more club heads. The connector comprises a male connector and a female connector, each adapted to attach to a section of a separable golf club shaft.

The connector facilitates assembly of a club by providing an alignment mechanism by which the male connector is aligned with the female connector, and preferably one in which this alignment occurs prior to the engagement of respective threaded portions on each connector portion.

This alignment may be achieved by providing the male connector with a protruding portion having a blunt tip section, a threaded section, and a smooth alignment section. The female portion has an interior space comprising at least three cavities, wherein one cavity receives the blunt tip section, another cavity receives the smooth alignment section, and yet another cavity has a threaded portion that receives the threaded section of the protruding portion of the male connector. Preferably, the smooth section of the protruding portion engages the female connector before the respective threaded sections are engaged. In this manner, the threaded portion of the male connector is aligned by the smooth section of the male connector. The blunt tip section may also assist in the axial alignment by engaging the female connector prior to the engagement of the respective threaded sections.

Figure 1:
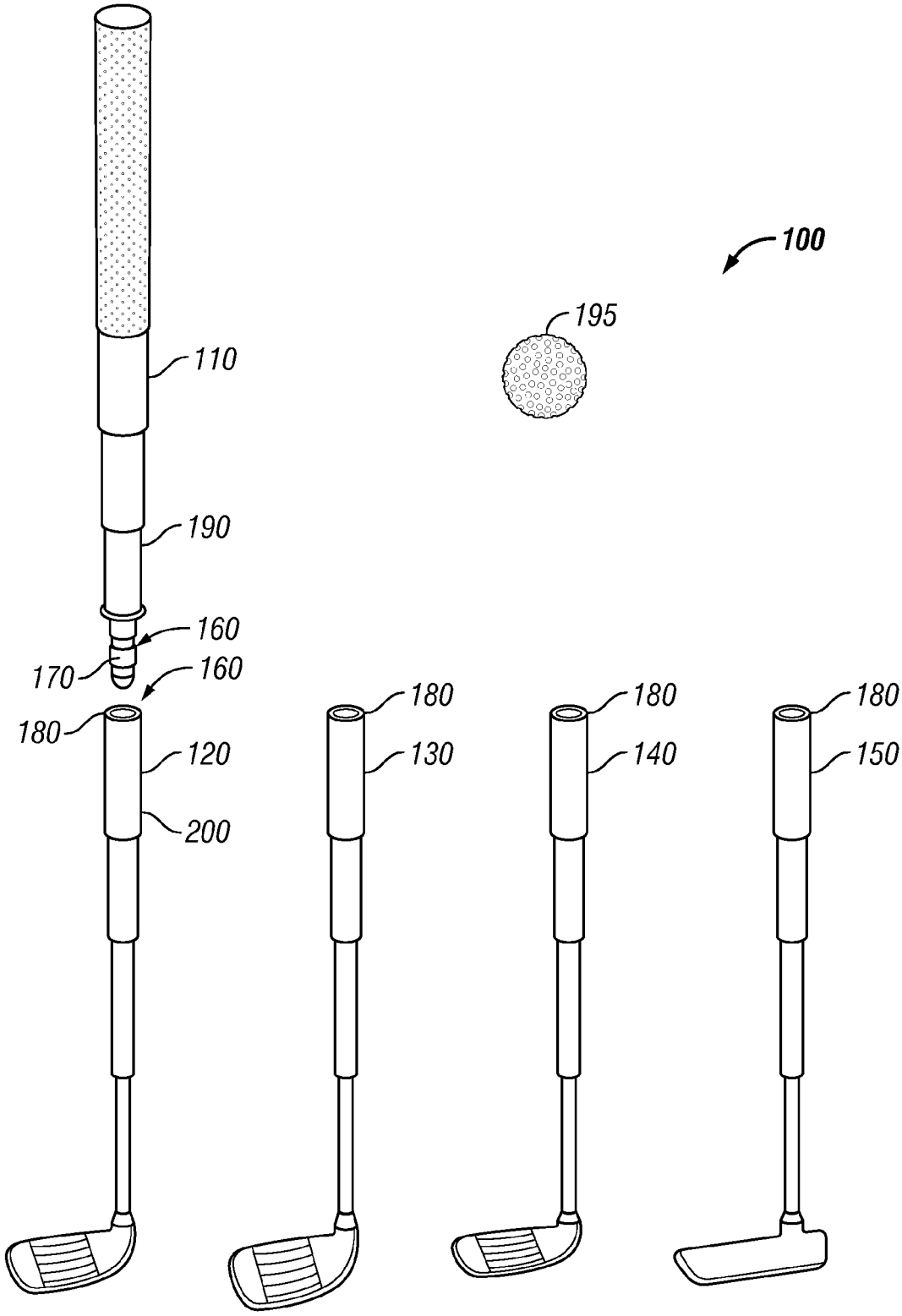
FIG. 1 is an embodiment of a golf club system of the present invention.

Referring now to FIG. 1, a golf clubs system in accordance with the present invention is described. It will be appreciated that a golf club system comprises one or more separable club components. In the embodiment shown in FIG. 1, system 100 comprises a single grip section 110 of a golf club shaft, as well as four club head sections 120, 130, 140, and 150 of golf club shafts. Grip section 110 may be selectively attached to club head section 120, 130, 140, or 150 by connector 160.

Connector 160 comprises male connector 170 and female connector 180. Male connector 170 is attached to grip section 110, and female connector 180 is attached to club head section 120. Club head sections 130, 140, and 150 each are attached to additional female connectors 180, such that they may be interchangeably coupled to grip section 110. Male connector 170 and female connector 180 are described in greater detail below.

In a preferred embodiment, grip section 110 comprises a first shaft member 190, and club head section 120 comprises a second shaft member 200. Shaft members 190 and 200 preferably are hollow steel or other metallic substance. The exterior of male connector 170 is attached to grip section 110 at an interface with the interior of first shaft member 190, whereas the exterior of female connector 180 is attached to club head section 120 at an interface with the interior of second shaft member 200.

It will be appreciated by one of skill in the art that modifications could be made to system 100. For example, the set could comprise greater or lesser number of club heads or grips. Likewise, the female connector may be attached to the grip section, whereas each of the club head sections may be attached to a respective male connector. It is intended that all such modifications be within the scope of this invention.

Optionally, system 100 may further comprise ball 195. Ball 195 may be a previously-known golf ball or a practice ball such as that described in U.S. Pat. No. 4,886,275. It will be appreciated that it may be desirable for ball 195 to comprise a non-regulation or practice golf ball if golf system 100 is to be used for practice.

Figure 2:
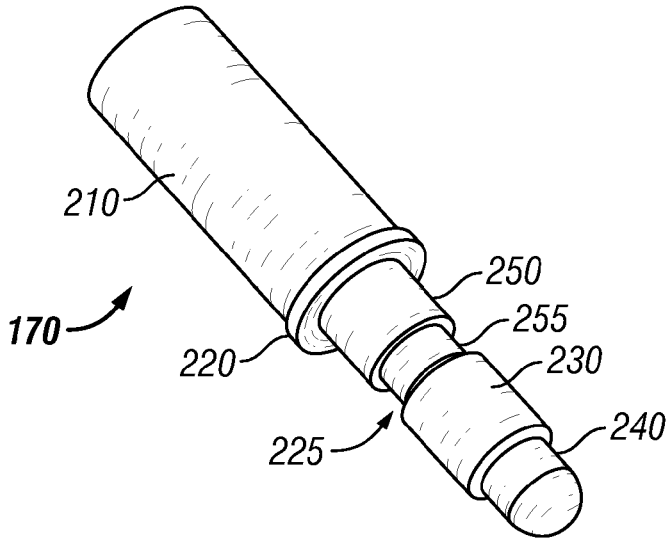
FIG. 2 is a perspective view illustrating an embodiment of a male connector of the present invention.
Figure 3:
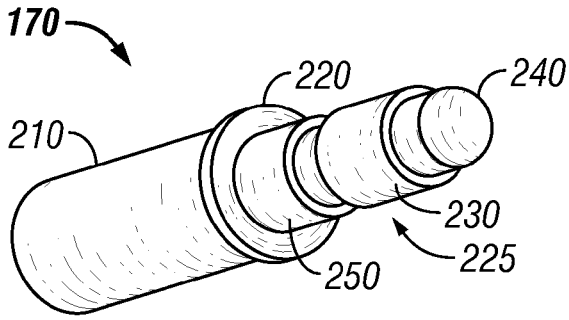
FIG. 3 is a perspective view illustrating an embodiment of a male connector of the present invention.
Figure 4:
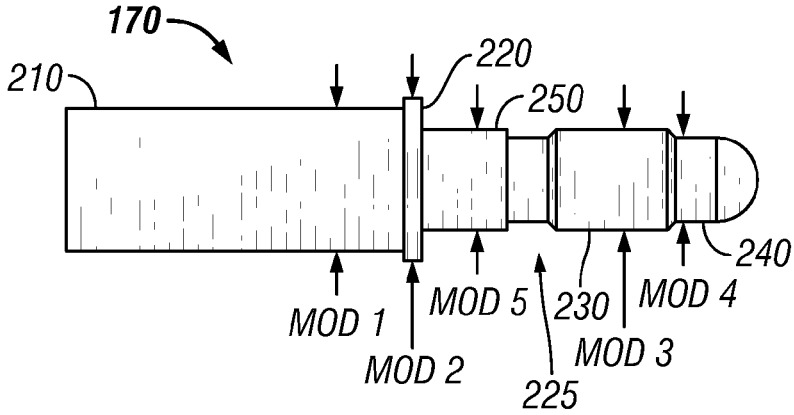
FIG. 4 is a side view illustrating an embodiment of a male connector of the present invention.
Figure 5:
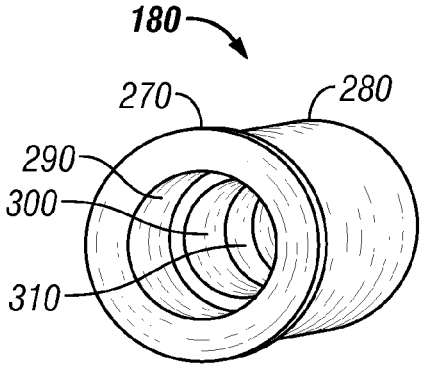
FIG. 5 is a perspective view illustrating an embodiment of a female connector of the present invention.
Figure 6:
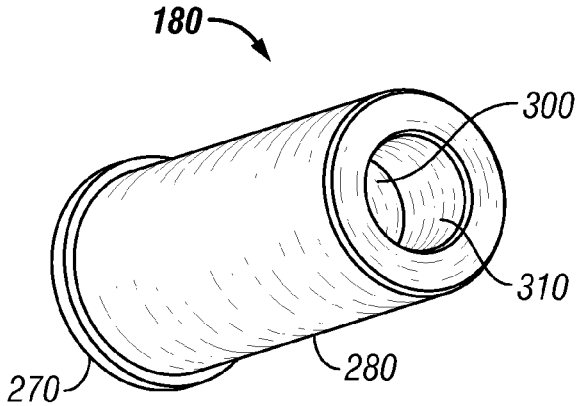
FIG. 6 is a perspective view illustrating an embodiment of a female connector of the present invention.
Figure 7:
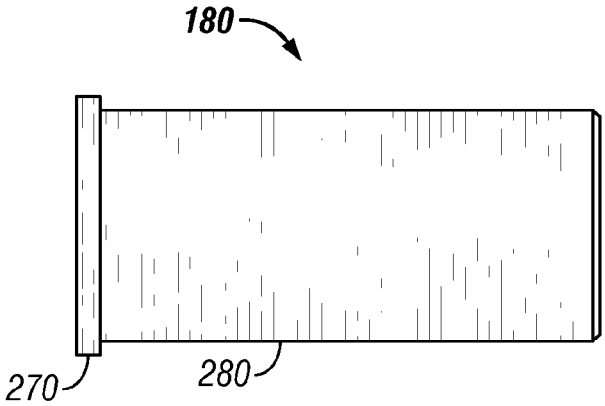
FIG. 7 is a side view illustrating an embodiment of a female connector of the present invention.
Figure 8:
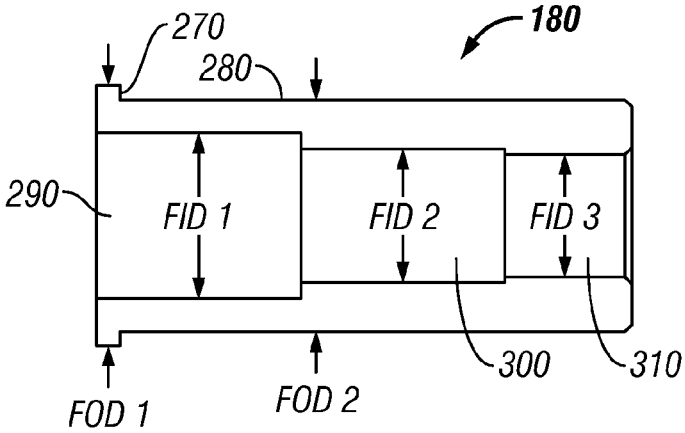
FIG. 8 is a sectional view illustrating an embodiment of a female connector of the present invention.

Referring now to FIGS. 2-4, an embodiment of a male connector in accordance with the present invention is described. Male connector 170 comprises attachment portion 210 with outer dimension MOD1, shoulder portion 220 with outer dimension MOD2, and protruding portion 225. Protruding portion 225 includes threaded section 230, tip section 240, and smooth section 250.

Attachment portion 210 of male connector 170 is dimensioned to fit within a cavity of a golf club shaft member. Attachment portion 210 may have a surface that is relatively smooth, irregular, threaded, dimpled, or otherwise configured to engage the interior of the golf club shaft member.

Shoulder portion 220 of male connector 170 is an optional component that, when present, preferably is dimensioned such that MOD2 is at least as wide as the end portion of the golf club shaft member to which male connector 170 is attached. Shoulder portion 220 may have a circular cross section, such as may provide an aesthetically pleasing appearance, or have another shape, such as hexagonal to allow manipulation by a wrench.

Threaded section 230 of protrusion portion 225 of male connector 170 preferably is threaded over all or at least a portion of its exterior surface. Threaded section 230 has an outer dimension MOD3.

Tip section 240 preferably has an elongated extension with a blunt tip and a circular cross section. Tip section 240 has an outer dimension MOD4, where MOD3 is greater than MOD4. Tip section 240 is provided to assist in properly orientating male connector 170 to female connector 180 when assembling connector 160. It will be appreciated by one of skill in the art that the ease of aligning male connector 170 to female connector 180 is related to the length that tip section 240 extends from threaded section 230.

Smooth section 250 preferably has a relatively smooth exterior surface and a circular cross section. Additionally, smooth section 250 has an outer dimension MOD5, where MOD5 is preferably greater than MOD4.

Optionally, neck section 255 is disposed between smooth section 250 and threaded section 230. Neck section 255 has an outer dimension that is less than one or both of MOD5 and MOD3.

Referring now to FIGS. 5-8, an embodiment of a female connector in accordance with the present invention is described. Female connector 180 has shoulder section 270 having outer dimension FOD1, attachment section 280 having outer dimension FOD2, first cavity 290 having interior dimension FID1, second cavity 300 having interior dimension FID2, and third cavity having interior dimension FID3. First cavity 290, second cavity 300, and third cavity 310 are preferably adjacent and define an interior space of female connector 180.

Shoulder section 270 of female connector 180 preferably is dimensioned such that FOD1 is at least as wide as the end portion of the golf club shaft member to which female connector 180 is attached. Shoulder section 270 may have a circular cross section, such as may provide an aesthetically pleasing appearance, or have another shape, such as hexagonal to allow manipulation by a wrench. It will be appreciated that FOD1 may, but need not, be selected to be the same size as MOD2.

Attachment section 280 of female connector 180 is dimensioned to fit within a cavity of a golf club shaft member. Attachment section 280 may have a surface that is relatively smooth, irregular, threaded, dimpled, or otherwise configured to engage the interior of the golf club shaft member.

First cavity 290 of female connector 180 preferably is defined at least in part by a relatively smooth surface of female connector 180 and preferably is dimensioned such FIO1 is substantially similar to MOD5. In this regard, all or part of smooth section 250 may be disposed in first cavity 290 when male connector 170 is mated with female connector 180.

It will be appreciated that the axial length of first cavity 290 may be selected to be longer than the axial length of threaded section 230 of male connector 170. In this regard, during assembly smooth section 250 may engage female connector 180 before threaded section 230 engages the threaded portion of the interior surface of female connector 180 defining second cavity 300.

Second cavity 300 of female connector 180 preferably is threaded for at least a portion of its length. In particular, FID2 and MOD3 preferably are selected so that threads of threaded section 230 on male connector 170 mate with threads on an interior surface of female connector 180 defining second cavity 300. The direction, or cut, of the threads may be selected based on the type of golf club with which connector 160 is utilized. For example, in a right handed set of clubs, connector 160 preferably is constructed with reverse (left-handed) threads. Conversely, in a left handed set of clubs, connector 160 preferably is constructed with conventional (right-handed) threads. Accordingly, male connector 170 and female connector 180 are urged together when a user hits a golf ball with the club head regardless of whether the golf club system is designed for right-handed golfers or left-handed golfers.

Female connector 180 further comprises third cavity 310 having interior dimension FID3. Third cavity 310 of female connector 180 preferably is dimensioned such that FID3 is substantially similar to MOD4. In this regard, tip section 240 may be disposed in third cavity 310 when male connector 170 is mated with female connector 180.

Figure 9:
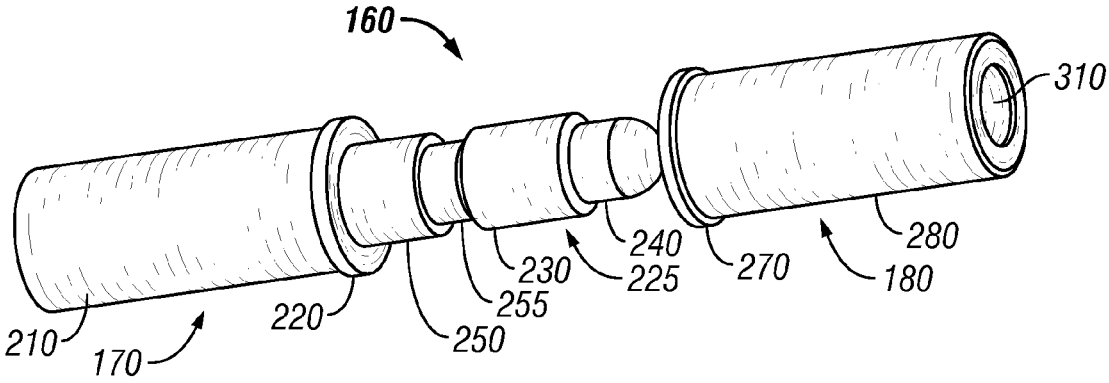
FIG. 9 is a perspective view of an embodiment of a connector for a golf club system of the present invention.
Figure 10:
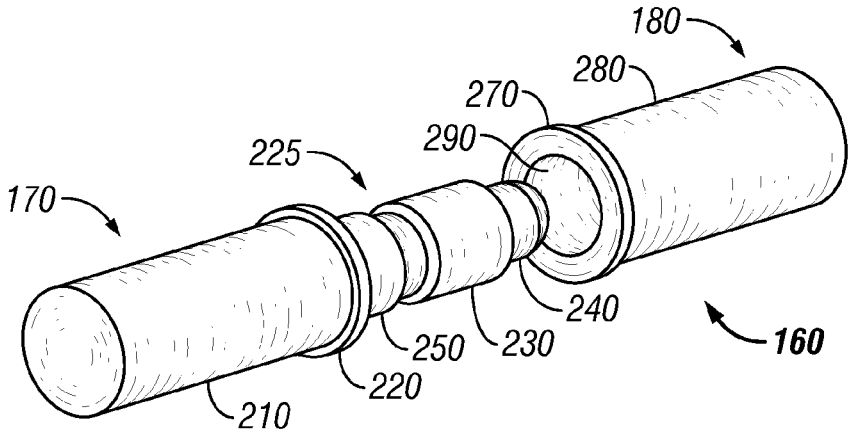
FIG. 10 is a perspective view of an embodiment of a connector for a golf club system of the present invention.

Referring now to FIGS. 9-10, connector 160 is described with male connector 170 axially aligned with female connector 180. In this orientation, protruding portion 225 may be inserted in the space defined by female portion. In particular, tip section 240 of protruding portion 225 is first inserted into first cavity 290, then into second cavity 300, and then into third cavity 310.

When male connector 170 is mated with female connector 170 of connector 160, smooth section 250 is disposed at least in part in cavity 290, threaded section 230 is disposed at least in part in cavity 300, and tip section is disposed at least in part in cavity 310. Such a configuration is depicted in FIG. 11.

Figure 11:
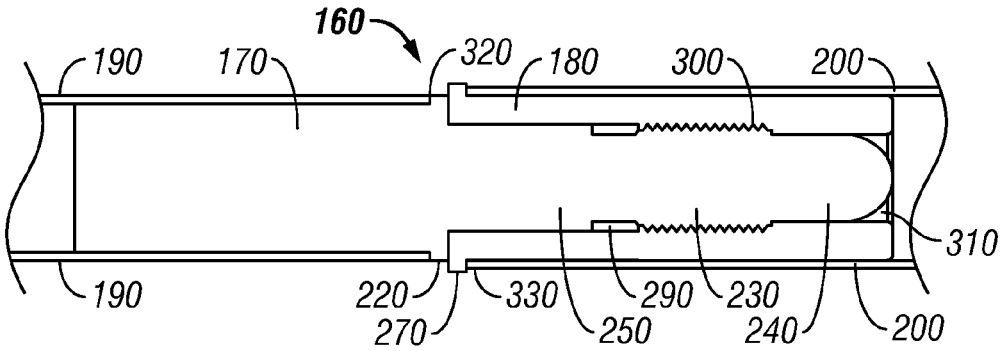
FIG. 11 is a sectional view taken along an axis of an embodiment of a connector in a golf club of the present invention.

Referring now to FIG. 11, a sectional view of an embodiment of connector 160 is depicted in which male connector 170 is attached to first shaft member 190 and female connector 180 is attached to second shaft member 200. In this embodiment, shoulder portion 220 of male connector 170 is round and is dimensioned such that MOD2 is substantially the same length as that of the end section 320 of first shaft member 190. Likewise, shoulder section 270 of female connector 180 is dimensioned such that FOD1 is substantially the same length as that of end section 330 of second shaft member 200, and slightly greater than that of MOD2. Shoulder portion 270 of female connector 180 may be beveled at the interface with shoulder portion 220 of male connector 170 to prevent exposing a golfer to sharp edges and also for aesthetical purposes.

It will be appreciated by one of skill in the art that the dimensions of protruding portion 225 of male connector 170, along with the dimensions of the corresponding cavities 290, 300, and 310, of female portion 180, may be varied in an axial direction. For example, as depicted in FIG. 11, the axial lengths of threaded section 230 and smooth section 250 of male connector 170, and cavity 290 of female connector, are selected such that a portion of smooth section 250 and the threads on threaded section 230 may be disposed in cavity 290. As such, smooth portion 250 aligns male connector 170 with female connector 180 prior to engagement of the threaded portions of each of those components. This alignment may be further provided by the positioning of tip section 240 in one or both of cavity 300 or cavity 310. Hence, there is a reduced likelihood of damage to the threads caused by misalignment of the male connector 170 and the female connector 180 during assembly.

Next, a preferred method of manufacturing a set of golf clubs in accordance with the present invention will be discussed. In this example, the conversion of a previously known set of golf clubs having hollow steel shafts is described, although it will be apparent to one of skill in the art that other types of clubs may be used or that a set of clubs in accordance with this invention may be assembled from all new shaft member components (i.e., not converted from a previously known golf club).

One step is providing a first shaft member and a second shaft member. One shaft member may be associated with a grip portion, whereas another shaft member may be associated with a club head. These shaft members may be individually manufactured, but in a preferred method, they are obtained through the conversion of a single shaft golf club to a golf club having a separable shaft.

When converting an existing golf club, this step comprises cutting the shaft of the existing golf club to provide a first golf club shaft member and a second golf club shaft member. When cutting an existing golf club shaft having a series of discrete steps of decreasing diameter from the grip toward the club head, it is desirable to cut the shaft at or near the transition point from one step to an adjoining step.

Another step is providing a male connector. The male connector comprises an attachment portion, a shoulder portion, and a protruding portion. The protruding portion preferably has a smooth section, a threaded section, and a top section.

The male connector is attached to the first golf club shaft member. Preferably, this step comprises attaching the attachment portion of the male connector to an interior portion of the first golf club shaft member. This attaching may be accomplished in a number of manners, including: providing threads on the first portion of the male connector and screwing that component into the first golf club shaft member; dimensioning the first portion of the male connector such that a friction fit is provided with the first golf club shaft member; using an epoxy to attach the first portion of the male connector to the interior of the first golf club shaft member; or by welding the first portion of the male connector to the interior of the first golf club shaft member. It will be appreciated that a number of other manners of attaching the male connector to the first golf club shaft member exist that employ known techniques.

Yet another step is providing a female connector. The female connector comprises a shoulder portion and an attachment portion. The female connector preferably has first, second, and third cavities defining an interior space.

The female connector is attached to the second golf club shaft member. Preferably, this step comprises attaching the second portion of the female connector to an interior portion of the second golf club shaft member. This attachment may be accomplished in a number of manners, as discussed above.

Once the male and female connectors are attached to the respective shaft members, the manufacture of the golf club system may be complete and the shaft members may be selectively coupled and uncoupled by engaging the screw threads of the male and female connectors. Of course, the golf club system may comprise more than one golf club. For systems having more than one club head section, additional club head sections are provided, preferably from different sizes of golf clubs, which are then attached to either a male or a female connector, consistent with the other club or clubs in the system. In this manner a golf club system may have a grip component and a plurality of club head components. For example, the system may comprise a first shaft member associated with a grip and a male connector, as well as a plurality of second shaft members each associated with a respective female connector and one of a putter or wedge club heads.

Although preferred illustrative embodiments of the present invention are described above, it will be evident to one skilled in the art that various changes and modifications may be made without departing from the invention. It is intended in the appended claims to cover all such changes and modifications that fall within the true spirit and scope of the invention.

What is claimed is:

1. An apparatus for connecting a first member of a golf club shaft and a second member of a golf club shaft, the apparatus comprising:

a male connector having a male attachment portion, a protruding portion, and a male shoulder portion therebetween, the protruding portion comprising a tip section, a threaded section, and a smooth section, the smooth section disposed between the threaded section and the shoulder portion, the threaded section disposed between the smooth section and the tip section, the tip section having a blunt tip, the smooth section having an outer dimension that is greater than or equal to an outer dimension of the threaded section, and the male attachment portion dimensioned to be received in an interior space of an end of the first member so that the male shoulder portion abuts against the end of the first member; and a female connector having an attachment portion, a shoulder portion, and an interior space having first, second, and third cavities, the female attachment portion dimensioned to be received in an interior space of an end of the second member so that the female shoulder portion abuts against the end of the second member, the female connector having a relatively smooth interior surface defining at least a portion of the first cavity and a threaded interior surface defining at least a portion of the second cavity, and the third cavity adapted to receive at least a portion of the tip section;

wherein the interior space is dimensioned to selectively receive at least a portion of the smooth section in the first cavity and at least a portion of the threaded section in the second cavity, and wherein the protruding portion further comprises a neck section disposed between the threaded section and the smooth section, the neck section having an outer diameter less than an outer diameter of the threaded section.

2. The apparatus of claim 1 wherein the third cavity has an interior dimension that is less than an interior dimension of the second cavity.

3. The apparatus of claim 1 further comprising a second male connector having a second male attachment portion, a second male shoulder portion, and a second protruding portion, wherein the second protruding portion is matable with the female connector.

4. The apparatus of claim 1 further comprising a second female connector having a second female attachment portion, a second female shoulder portion, and a second interior space, wherein the second female connector is matable with the male connector.

5. A golf club system comprising:

a first golf club shaft member having an end and a first interior space;

a second golf club shaft member having an end and a second interior space;

a club head attached to one of the first or second golf club shaft members;

a male connector having a male attachment portion and a protruding portion, the male attachment portion disposed in the first interior space, the protruding portion comprising a tip section, a threaded section, and a smooth section, the smooth section disposed between the threaded section and the male attachment portion and the threaded section disposed between the smooth section and the tip, the smooth section having an outer dimension that is greater than or equal to an outer dimension of the threaded section, and the tip section having a blunt tip; and a female connector having a female attachment portion and a third interior space having first, second, and third cavities, the female attachment portion disposed in the second interior space, the female connector having a relatively smooth interior surface defining at least a portion of the first cavity, a threaded interior surface defining at least a portion of the second cavity, and the third cavity adapted to receive at least a portion of the tip section;

wherein the interior space of the female portion is dimensioned to selectively receive at least a portion of the smooth section of the male connector in the first cavity and at least a portion of the threaded section of the male connector in the second cavity, and wherein the protruding portion further comprises a neck section disposed between the threaded section and the smooth section, the neck section having an outer diameter less than an outer diameter of the threaded section.

6. The apparatus of claim 5 wherein the third cavity has an interior dimension that is less than an interior dimension of the second cavity.

7. The apparatus of claim 6 wherein the male connector further comprises a male shoulder portion disposed between the male attachment portion and the smooth section, the male shoulder portion dimensioned to abut against the end of the first golf club shaft member.

8. The apparatus of claim 6 wherein the female connector further comprises a female shoulder portion adjacent the female attachment portion and dimensioned to abut against the end of the second golf club shaft member.

9. The apparatus of claim 5 further comprising a third golf club shaft member having a second club head, the third golf club shaft member selectively matable to one of the first or second golf club shaft members.

* * * * *